United States Patent [19]

Kuzuya et al.

[11] Patent Number: 4,927,278

[45] Date of Patent: May 22, 1990

[54] TAPE CASSETTE AND TAPE PRINTER FOR USE THEREWITH

[75] Inventors: Susumu Kuzuya, Gifu; Yoshiaki Nagao, Mizuho; Hideo Asakura, Nagoya; Shigenori Hattori, Aichi, all of Japan

[73] Assignee: Brother Kogyo Kabushiki Kaisha, Nagoya, Japan

[21] Appl. No.: 291,143

[22] Filed: Dec. 28, 1988

[30] Foreign Application Priority Data

| | | | |
|---|---|---|---|
| Dec. 29, 1987 | [JP] | Japan | 62-199662[U] |
| Oct. 17, 1988 | [JP] | Japan | 63-135230[U] |
| Oct. 17, 1988 | [JP] | Japan | 63-135277[U] |

[51] Int. Cl.[5] ..... B41J 35/28

[52] U.S. Cl. ..... 400/208; 400/207; 156/387

[58] Field of Search ..... 400/208, 208.1, 207, 400/249, 696, 695, 697.1, 82; 346/76 PH; 156/387, 384

[56] References Cited

U.S. PATENT DOCUMENTS

| | | | |
|---|---|---|---|
| 4,068,028 | 1/1978 | Samonides | 156/384 |
| 4,153,496 | 5/1979 | Swift | 156/384 |
| 4,302,118 | 11/1981 | Schaefer | 400/208 |
| 4,700,976 | 10/1987 | Loose | 156/384 |

FOREIGN PATENT DOCUMENTS

| | | | |
|---|---|---|---|
| 0267890 | 5/1988 | European Pat. Off. . | |
| 0272232 | 6/1988 | European Pat. Off. . | |
| 142114 | 8/1984 | Japan | 156/387 |
| 199277 | 11/1984 | Japan | 156/387 |
| 115775 | 5/1988 | Japan | 400/82 |

*Primary Examiner*—Edgar S. Burr
*Assistant Examiner*—Joseph R. Keating
*Attorney, Agent, or Firm*—Jones, Tullar & Cooper

[57] ABSTRACT

A tape cassette is disclosed, in the housing of which are provided accommodation sections accommodating an ink ribbon, an image receiving tape and an adhesive tape, respectively. The tape cassette is set in a tape printer, and printing is done in a mirror image transfer mode on the printing surface of the tape from the printing head via the ink ribbon. After the printing, the tape is fed out together with the adhesive tape applied to the printing surface.

The cassette housing can be used for a label tape cassette and also for an instant lettering tape cassette, and the image transfer mode of the tape printer is never changed irrespectively of the types of tape cassettes used with the tape printer.

10 Claims, 17 Drawing Sheets

TAPE CASSETTE AND TAPE PRINTER FOR USE THEREWITH

CROSS REFERENCE TO RELATED APPLICATION

This application discloses subject matter in common with the application entitled: TAPE PRINTER. Both applications have common inventive entities and a common assignee.

BACKGROUND OF THE INVENTION

This invention relates to a tape cassette provided with an image source tape such as ink ribbon and an image receiving tape and also to a tape printer for use with such a tape printer, the tape printer having a printing head and a platen disposed in a face-to-face relation to each other such that the two tapes in the tape cassette are driven through a printing area between the printing head and platen for printing an image from the printing head onto the image receiving tape via the image source tape by, for instance, a thermal printing process or a thermal transfer process, the image receiving tape after the printing being used as label or the like.

In the prior art tape printer, however, the printing is done on the non-adhesive surface of the single-side adhesive tape when obtaining a tape for general display or as a label. Therefore, after the tape is applied at an intended position or to an intended object by separating the separable sheet, the printed image is liable to become blurred by being touched by an object. To prevent this, it is necessary to cover the printing surface by applying a transparent sheet or the like thereto, which is cumbersome. Further, peel-off of the print is liable to result due to direct contact of the printing surface with a feed roller when the tape is fed out of the tape printer after printing.

Further, the tape printer of the type described is mostly used to produce tapes for general display or serving as labels.

In other words, there has been no tape printer to produce a tape, which is used to obtain a lettering image by pushing a print on its image receiving tape on a separate sheet.

SUMMARY OF THE INVENTION

The present invention has in the light of the above problems inherent in the prior art, as its object to provide a tape cassette, which is richly versatile and permits production of a tape for general display or serving as a label and with the printing surface protected to prevent direct contact while also permitting production of a tape (hereinafter referred to as a lettering tape) used to obtain an instant lettering image on a separate sheet by pushing the printing surface thereon, and also a tape printer, which is used with such a tape cassette, simple in construction and operation and inexpensive.

To attain the above object of the invention, there is basically provided a tape cassette, which has a housing formed with first to third accommodation sections, the first and second accommodation sections respectively accommodating an image source tape and a substantially transparent image receiving tape, the third accommodation section accommodating an adhesive tape having an adhesive surface to be applied to the printing surface of the image receiving tape after printing thereon of an image.

With this structure, the printing surface is protected by the adhesive tape, so that the printed image will never be damaged with rubbing of the printing surface while or after the produced tape is fed out of the tape printer. Further, it is arranged such that a transferred image is a mirror image, a durable tape may be produced, which can be used for general display or as a label such that the printing surface of a transparent image receiving tape is seen from the back side opposite the printing surface.

In a preferred structure according to the invention, one of first and second feed roller means for feeding out the image receiving tape after printing together with the adhesive tape is disposed in the tape cassette, and with the loading of the tape cassette in the tape printer frame the other feed roller means provided in the tape printer frame is urged against the aforesaid one feed roller means so that the tapes are fed out in a state clamped between the two feed roller means.

With this structure, when the tape cassette is loaded and unloaded, the image receiving tape and adhesive tape can be held applied to each other on the aforesaid one feed roller means. In other words, such a cumbersome operation of passing the free end of the tape through a narrow slit at the time of setting the tape is unnecessary.

In a further preferred structure according to the invention, the first to third accommodation sections are juxtaposed side by side substantially in the same plane in the tape cassette housing, and the third accommodation section which accommodates the adhesive tape is disposed closer to the tape outlet than the other accommodation sections.

With this section, the path of transport of the adhesive tape up to the tape outlet can be reduced, which is desired for avoiding occasional contact of the adhesive tape with peripheral components in the tape cassette.

In a still further preferred structure according to the invention, the adhesive tape is a double-sided adhesive tape having one adhesive surface applied to the printing surface of the image receiving tape and the other adhesive surface, to which a separable sheet is applied.

With this structure, the produced tape may be applied after separation of the separable sheet at an intended position or to an intended object for general display or as a label such that the surface of the image receiving tape, which is transparent, opposite the printing surface is seen.

In a yet further preferred structure according to the invention, when assembling the tape cassette, which has the cassette housing with the first to third accommodation sections, for producing label tapes, a thermal transfer type image source tape and a thermal transfer type image receiving tape are accommodated in the respective first and second accommodation sections, while an adhesive tape is accommodated in the third accommodation section. On the other hand, when assembling the tape cassette for the production of lettering tapes, a thermal transfer type image source tape and a thermal transfer type image receiving tape are accommodated in the respective first and second accommodation sections, while nothing is accommodated in the third accommodation section.

With this structure, tape production cassettes having different purposes can be constructed by using a common cassette housing, and a cassette housing which is rich in versatility can be provided.

Further, with the above structure, the tape printer of the present invention can be adopted to produce various tapes of the different purposes noted above in a mirror image transfer mode. That is, there is no cumbersomeness of transfer mode switching, and there is no need of providing a control mechanism to such an end.

The above and other objects, features and advantages of the prevent invention will be more completely apparent from the following description with reference to the accompanying drawings.

BRIEF DESCRIPTION OF THE DRAWINGS

FIG. 21 is a fragmentary perspective view, to an enlarged scale, showing a label tape; and FIG. 22 is a fragmentary perspective view, to an enlarged scale, showing a lettering tape.

DESCRIPTION OF THE PREFERRED EMBODIMENTS

Figure 1:
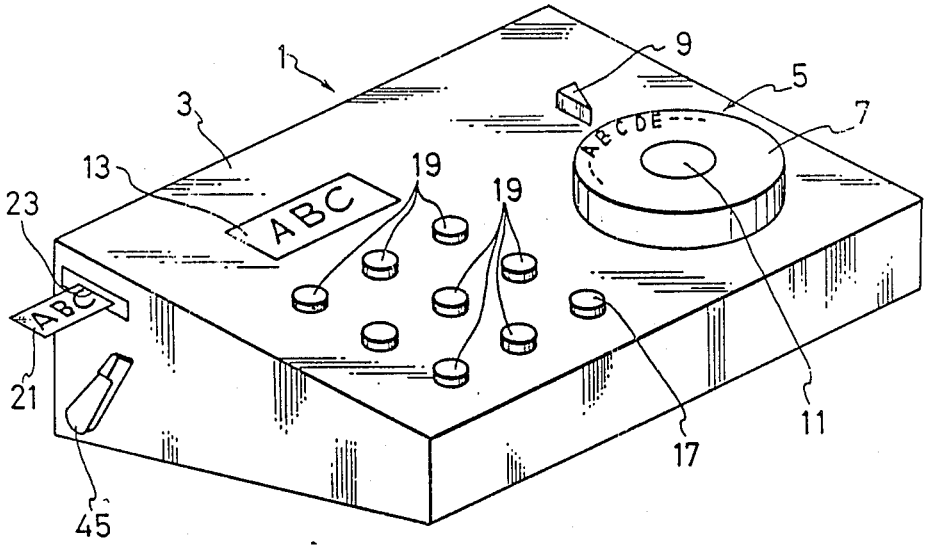
FIG. 1 is a perspective view showing a tape printer as a first embodiment of the invention viewed from the front side.
Figure 2:
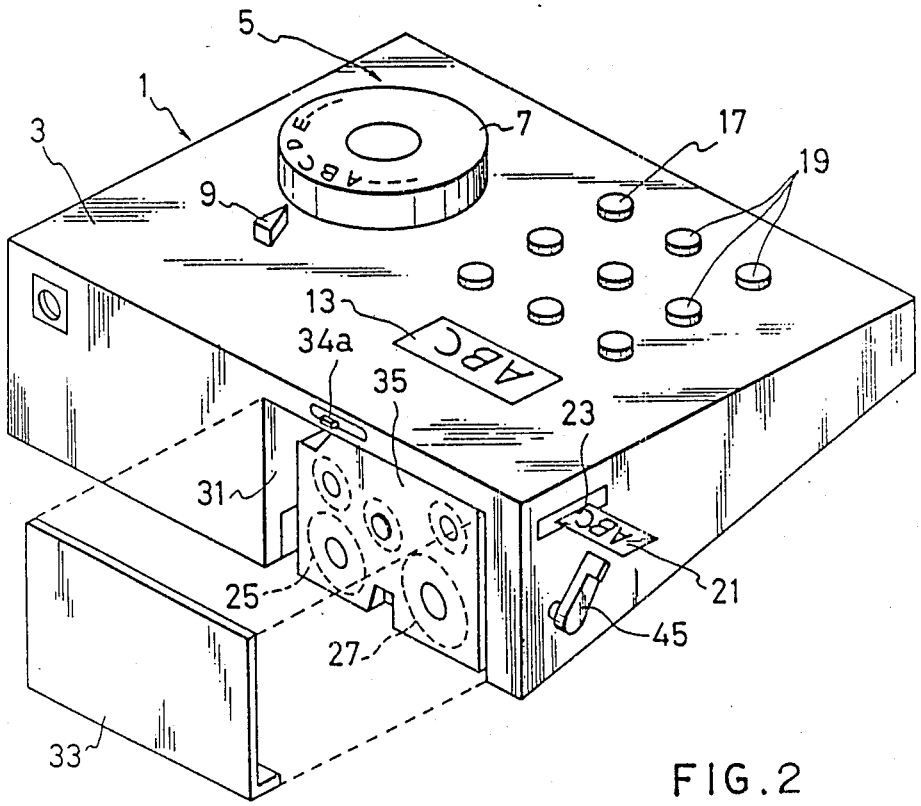
FIG. 2 is a perspective view showing the taper printer of FIG. 1 with a cassette cover removed and viewed from the back side.

FIGS. 1 and 2 show the overall structure of a tape printer as a first embodiment of the invention. The tape printer 1 has a frame 3, on top of which a rotary character selection dial 5 is provided. The character selection dial 5 has an annular shape, and on its annular dial surface 7 impressions of alphabet letters, symbols and other characters (hereinafter collectively referred to as characters) are provided at a uniform interval.

On top of the frame 3 is also provided adjacent to the character selection dial 5 a pointer 9 which determines a character selection position of the dial 5. On the inner side of the dial 5, a determination key 11 is provided concentrically. By depressing the determination key 11 after manipulating the character selection dial 5 for character selection, a character at the position corresponding to the pointer 9 is determined as input character. Characters which are consecutively set to the position corresponding to the pointer are displayed in the same order on a liquid crystal display 13 on top of the frame 3 from the lowest place by a character selection mechanism and control means provided on top of the frame 3. Every time a character determination process is done by the determination key 11, the displayed characters are scrolled to higher places by one place. The input characters are consecutively stored in an internal memory.

On top of the frame 3 and adjacent to the character selection dial 5 there are further provided a point key 17 and a plurality of function keys 19 which are operable for controlling the tape printer 1. When the print key 17 is operated, a label tape 21 is produced. The label tape 21 thus produced bears an impression or image or characters displayed on the liquid crystal display 13 and stored in the internal memory. It is fed out of the frame 3 through a tape outlet 23 provided on one side of the frame 3. It is cut to a suitable length, the cut tape being used for general display or applied for use as a label to a sheet or other object.

Figure 3:
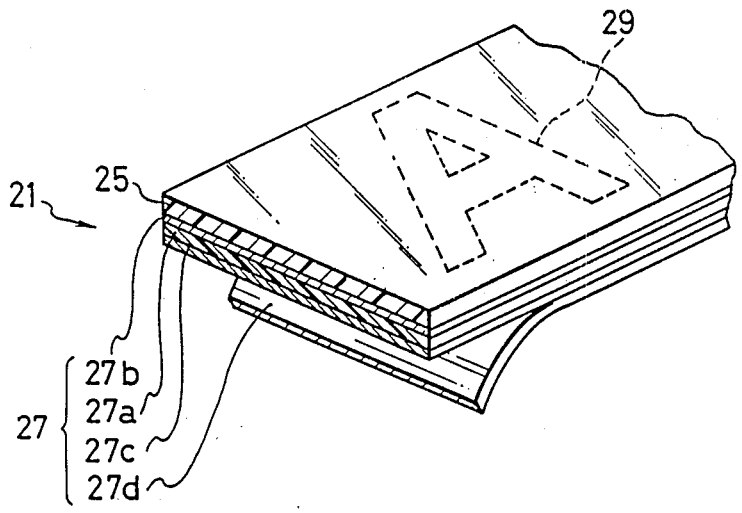
FIG. 3 is a fragmentary perspective view, to an enlarged scale, showing a label tape formed by the same tape printer.

FIG. 3 shows the structure of the label tape produced by the tape printer 1 in the manner as described above.

The tape 21 consists of a transparent tape 25 as printing tape or image receiving tape and a double-sided adhesive tape 27 applied to the transparent tape 25. The double-sided adhesive tape 27 has a transparent base **27*a* with opposite side, i.e., first and second adhesive surfaces 27*b* and 27*c* and a separable sheet 27*d* applied to the second adhesive surface 27*c*. On the back side of the transparent tape 25, a character image impression 29 is formed by the tape printer 1 such that it is a positive image when viewed from the front surface side of the transparent tape 25. The back surface of the transparent tape 25 and the first adhesive surface 27*b* of the double-sided adhesive tape 27 are applied together. That is, the back surface of the tape 25 serves as the printing surface. The print image 29 thus is sandwiched between the transparent tape 25 and double-sided adhesive tape 27 and will never be contaminated or become blurred due to friction. The tape 21 is cut to a suitable length, and then by separating the separable sheet 27 it is applied to an intended sheet or other object by the adhesive force of the exposed second adhesive surface 27*c***.

Figure 18:
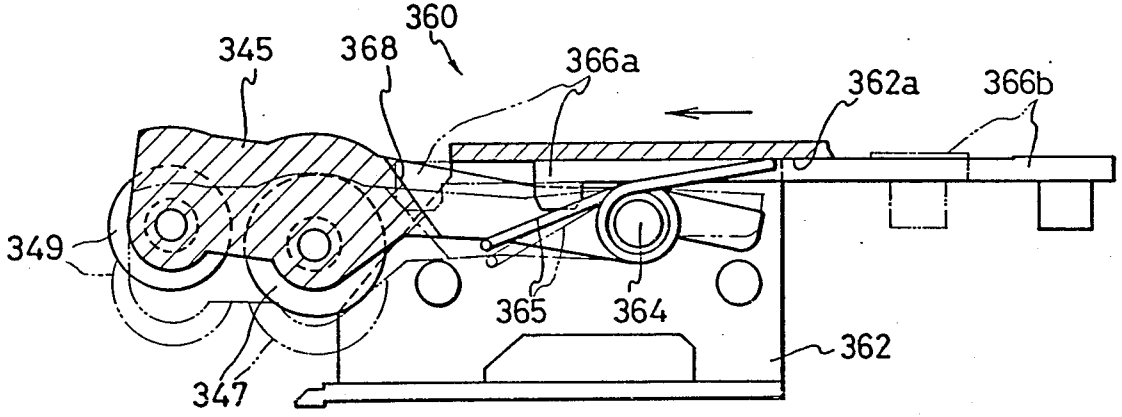
FIGS. 18 and 19 are fragmentary views, to an enlarged scale, showing a mechanism for operating a platen holder in the tape printer shown in FIG. 17.
Figure 19:
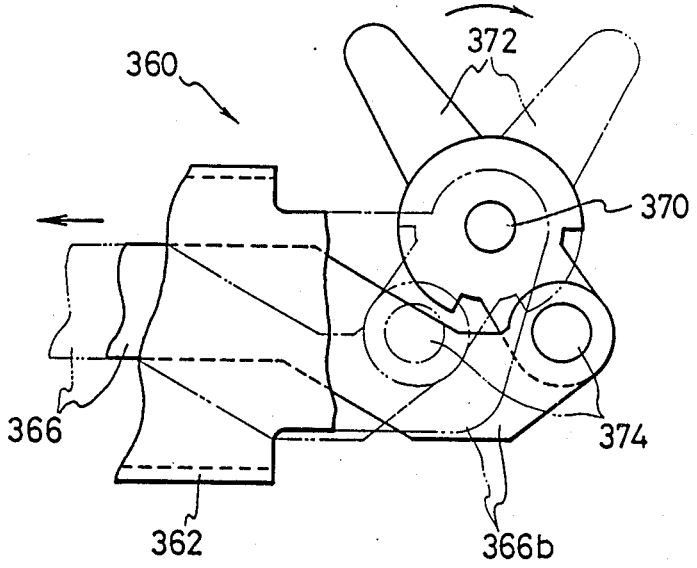

FIG. 2 shows the tape printer 1 viewed from the back side. As is shown, the back side of the frame 3 is formed with a cassette accommodation recess 31, and a cassette cover 33 is mounted to close the opening of the recess 31. Above the cassette accommodation recess 31, a release lever 34*a* is slidably provided on the frame 3. When the lever 34*a* is moved to the right in FIG. 2, a platen holder 59 to be described later is raised by a mechanism 34 (FIGS. 4 and 5) to bring thermal head 83 and platen 75 to their inoperative position The mechanism 34 uses suitable cam means. Although it is not described in detail in connection with this embodiment, an example of the mechanism is shown in FIGS. 18 and 19 and described in connection with a subsequent embodiment.

Now, a tape cassette 35 which is loaded in the cassette accommodation recess 31 and a printing mechanism of the tape printer 1 will be described.

Figure 4:
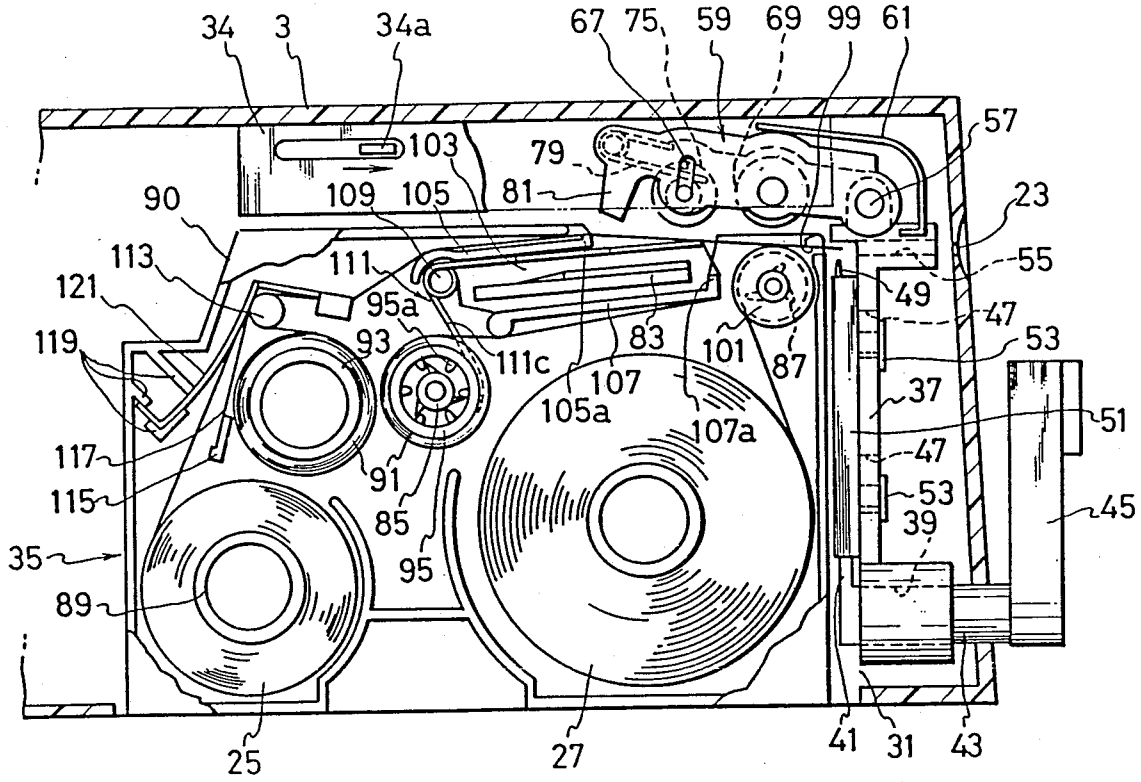
FIG. 4 is a sectional view showing the same tape printer with a frame and a tape cassette shown partly broken apart.
Figure 5:
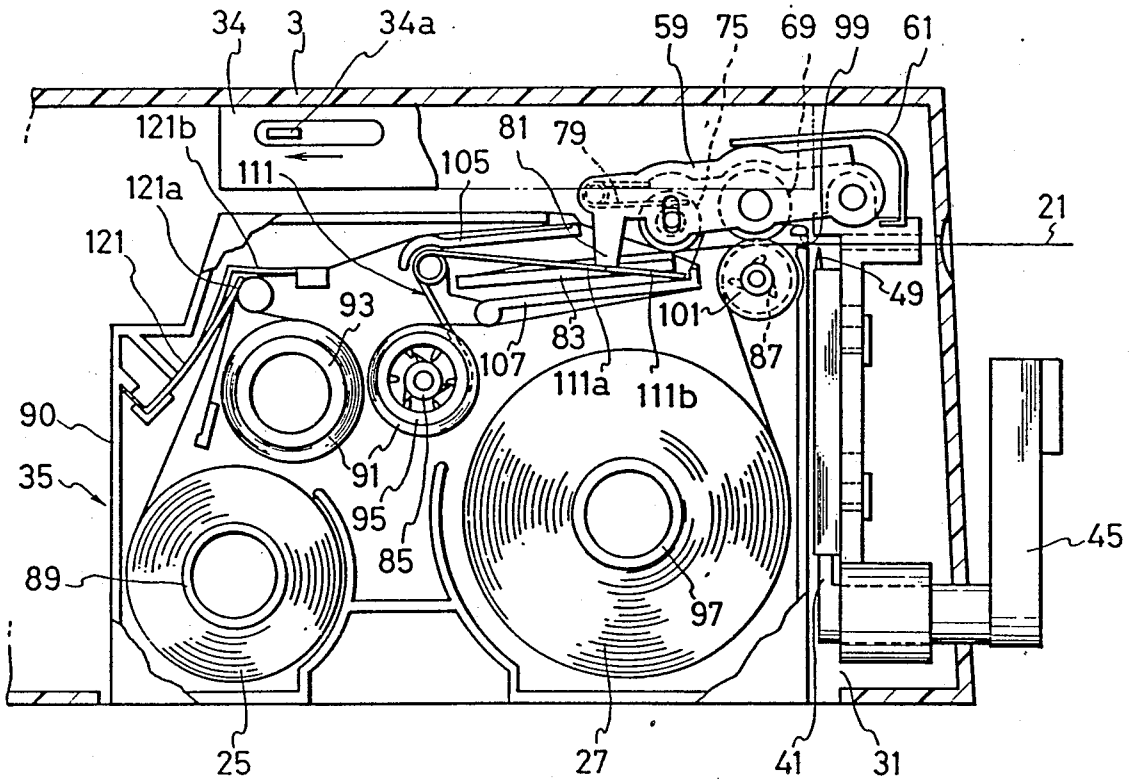
FIG. 5 is a view corresponding to FIG. 4 but showing the tape printer in a printing operation.

FIGS. 4 and 5 are sections taken in a plane through the tape outlet 23 of the frame 3 and also show part of the tape cassette 35 in a broken form. As shown in these Figures, a side frame 37 is provided in the frame 3 adjacent to the tape outlet 23. The side frame 37 is formed adjacent to its lower end with a hole 39, in which is rotatably mounted a cam shaft 43 having a cam 41 provided at one end. A cutter lever 45 is secured to the other end of the cam shaft 43 extending outwardly from the frame 3. The side frame 37 is formed with two, vetically aligned, vertically elongated slots 47. A cutter holder 51 having a cutter 49 provided at the upper end is mounted on the side frame 37 by two flat screws 53 passed through the respective slots 47 such that it is vertically movable along the side frame 37 in a range corresponding to the vertical dimension of the slots 47. The cutter holder 51 is downwardly biased by a tension spring (not shown), and its downward movement is limited as its lower end strikes the cam 41 of the cam shaft 43. The cutter holder 51 is movable vertically as the position of contact between the cam 41 and its lower end is changed with the rotation of the cutter lever 45.

A tape path 55, along which the label tape 21 is driven, is formed above the side frame 37 such that it extends to the tape outlet 23. A support shaft 57 is provided above the tape path 55. The platen holder 59 noted above is mounted on the support shaft 57 such that it is rotatable between a release or inoperative position as shown in FIG. 4 and a contact or operative position as shown in FIG. 5. The platen holder 59 is biased downwardly, i.e., toward the operative position, by the restoring force of a curved leaf spring 61 having one end secured to the side frame 37. FIG. 4 shows the platen holder 59 having been raised by the mechanism 34 against the biasing force of the leaf spring 61 caused by rightward movement of the release lever 34*a* as shown by arrow in FIG. 4.

Figure 6:
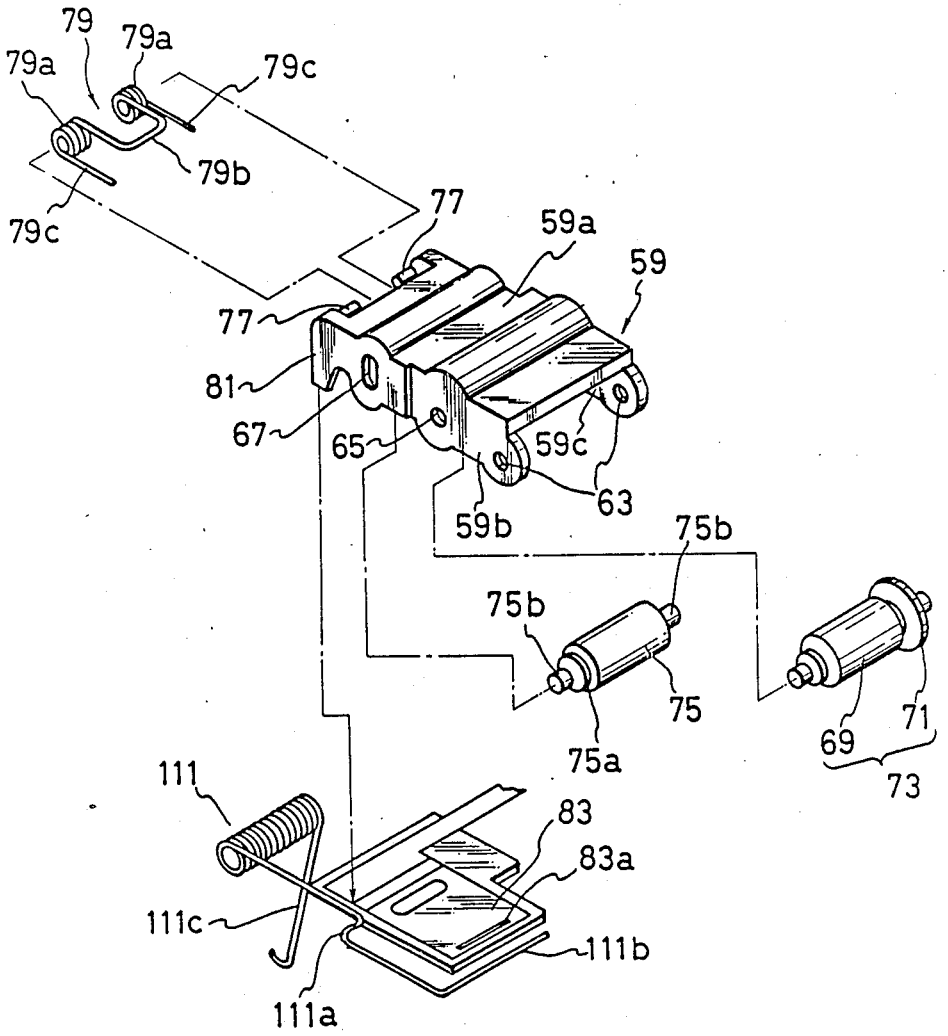
FIG. 6 is an exploded perspective view showing a platen holder, a printing head and neighboring components in the same tape printer.

The platen holder 59, as shown in FIG. 6, has a top portion 59*a* and a pair of depending portions 59*b* and 59*c* depending from the opposite sides of the top portion 59*a*. The depending portions 59*b* and 59*c* are each formed with a hole 63 receiving the support shaft 57 of the side frame 37, a hole 65 receiving a feed roller shaft and a vertically elongated hole 67 receiving a platen shaft 75*b*. A feed roller assembly 73 having a driven feed roller 69 and a driven gear 71 is rotatably mounted in the holes 65. In the holes 67 are rotatably mounted the corresponding platen shafts 75*b* supporting the platen 75 such that it is capable of slight vertical movement in a range corresponding to the vertical dimension of the holes 67 relative to the platen holder 59. Opposed short pins 77 project from the respective opposed surfaces of free ends of the depending portions 59*b* and 59*c* of the platen holder 59. A platen bias spring 79 is mounted in the short pins 77. This platen bias spring 79 has two coil spring portions 79*a* connected to each other by a connecting portion 79*b* and arm portions 79*c* each extending from the free end of each coil spring portion 79*a*. The platen bias spring 79, holes 67 and platen shaft 75*b* constitute elastic biasing means for supporting the platen 75 such that it is slightly movable vertically with respect to the platen holder 75.

More specifically, the platen bias spring 79 is mounted such that the coil spring portions 79*a* are fitted on the short pins 77, that the connecting portion 79*b* is in contact with the underside of the top portion 59*a* of the platen holder 59 and that the arm portions 79*c* are engaged with shoulders 75*a* formed at the opposite ends of the platen 75. The platen 75 thus is biased downwardly with a predetermined spring force provided by the elastic restoring force of the coil spring portions 79*a* of the platen bias spring 79. The spring force, with which the platen bias spring 79 biases the platen 75 is set to be weaker than the force, with which the leaf spring 61 biases the platen holder 59.

The free end of the depending portion 59*b* of the platen holder 59 is provided with an integral spring pushing piece 81 extending downwardly.

As shown in FIGS. 4 to 6, a thermal head 83 serving as a printing head is secured to the tape printer frame below the platen holder 59. The thermal head 83 has a printing element 83*a* consisting of a large number of heat-emitting resistors arranged in a row. It is positioned such that the printing element 83*a* is found on an orbit or movement of the platen 75 caused with the rotation of the platen holder 59. A take-up drive member 85 and a tape feeder 87, which can be reversibly driven by a stepping motor and a power transmission mechanism (both being not shown) are provided at predetermined positions such that they extend into the cassette accommodation recess 31. The power transmission mechanism for the take-up drive member 85 includes a slip mechanism, which provides a function such that the rate of take-up of tape on the take-up drive member 85 is varied according to the load on the drive member 85. The tape feeder 87 has an integral drive gear (not shown) meshed with the driven gear 71 of the feed roller assembly 73.

The tape cassette has a housing 90, in which reels 89, 93, 95 and 97 are rotatably provided at predetermined positions as shown in FIG. 4. The transparent tape 25 is wound on the reel 89. A thermal transfer ribbon 91*a* as an image source tape is wound with its ink surface inside on the reel 93 to be paid off this reel 93 and taken up on the reel 95. The double-sided adhesive tape 27 is wound with its separable sheet 27*d* outside on the reel 97. The reel 95 has six pawls 95*a* formed on the inner periphery for engagement with the take-up drive member 85. The housing 90 of the tape cassette 35 has an opening 99 serving as tape outlet, through which the tape 21 can be passed. The opening 99 is aligned to the tape path 55 when the tape cassette 35 is loaded in the tape printer 1. Near the opening 99, a cylindrical drive feed roller 101 is rotatably supported. The drive feed roller 101 has opposite side flanges and is capable of engaging with the tape feeder 87. The cylindrical portion of the drive feed roller 101 has substantially the same length as the width of the transparent tape 25 and double-sided adhesive tape 27.

The bottom of the housing 90 of the tape cassette 35 has a recess 103, into and out of which the thermal head 83 can be advanced and retreated. Along the edges of the recess 103, first and second guides 105 and 107 are provided integrally with the housing 90 such that they extend substantially parallel to the thermal head 83. Below the first guide 105, a support pin 109 is provided, and a coil spring 111 is mounted thereon. The coil spring 111 has two arms, one of which engages with the reel 95 to provide a rotational load thereto so that the taken-up thermal transfer ribbon 91 will not be occasionally re-paid-off. The other arm of the coil spring 111 has a bent portion 111*a*, as shown in FIG. 6, extending beyond the printing element 83*a* of the thermal head 83 and terminating in a ribbon guide arm 11*b* extending parallel to the printing element 83*a*. The bent portion 111*a* is located on the orbit of the spring pushing piece 81 moved with the rotation of the platen holder 59 when the tape cassette 35 is loaded in the tape printer 1.

Figure 8:
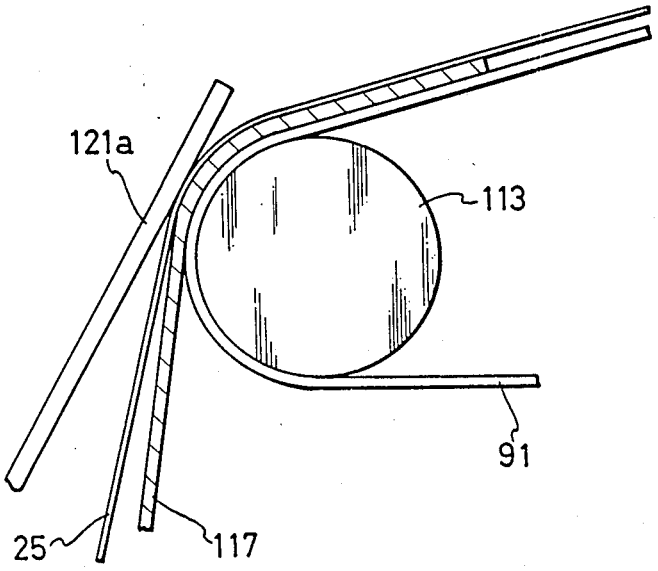
FIG. 8 is a plan view, to an enlarged scale, showing a main part of the structure shown in FIG. 7.

As shown in FIG. 4, the thermal transfer ribbon 91 paid off the reel 93 is guided by the guide pin 113, first guide 105, guide arm 111*b* and second guide 107 provided in the tape cassette 105 to be taken up on the reel 95. A support 115 is provided near the reel 93, and one end of a silicone-coated separator film 117 is secured to the support 115. The other end portion of the separator film 117 extends beyond the guide pin 113 as shown to an enlarged scale in FIG. 8. The transparent tape 25 paid off the reel 89 is overlapped over the thermal transfer ribbon 91 via the separator film 117 at the guide pin 113. The direct contact of the two tapes is thus prevented by the separator film 117, and the contamination of the tape 25 can be avoided. The tape 25, as shown in FIG. 5, is guided by the first guide 105 to proceed above the thermal head 83 toward the opening 99. When the tape 25 reaches the feed roller 101, it is applied to the double-sided adhesive tape 27 paid off the reel 97, so that it is fed out of the tape cassette 35 in the form of the label tape 21.

Figure 7:
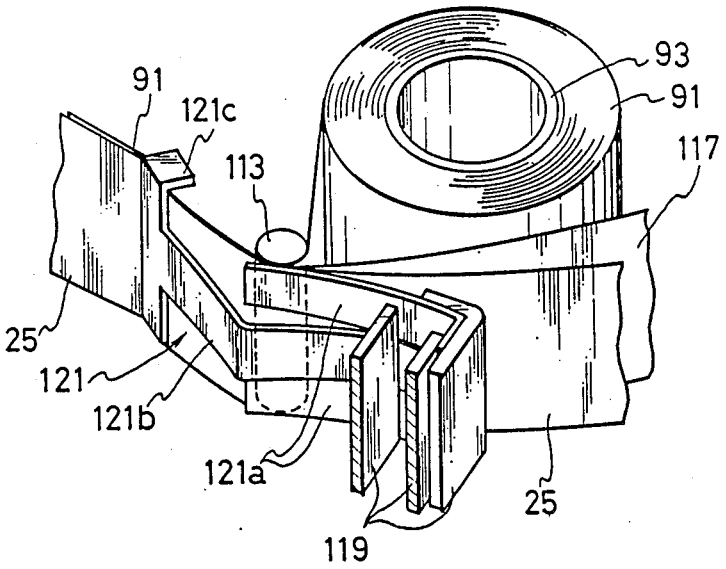
FIG. 7 is a perspective view, to an enlarged scale, showing a tape guide structure including a back tension spring in the same tape printer.

In the tape cassette 35, as shown in FIG. 4, three ribs 119 extend from a side wall of the housing 90 on the left side of the reel 93. These ribs 119 support a stem portion of a back tension spring 121. The back tension spring, as shown in FIG. 7, is formed from a single plate, and it has a pair of urging portions 121*a* extending from the stem portion and parallel to the tape running direction and a contact arm portion 121*b* also extending from the stem portion but intermediate between and independently of the urging portions 121*a*. The contact arm portion 121*b* is bent at a longitudinally intermediate position, and its free end portion is in contact with the transparent tape 25. It biases the transparent tape 25 and thermal transfer ribbon 91 overlapped over each other against the guide pin 113 and a left end portion of the first guide 105. Further, its free end portion has a pair of ear portions 121*c* having bend end portions. These ear portions 121*c* have an effect of restricting the movement of the tapes in the width direction thereof, thus preventing the meandering of the tapes. This action can be provided at all time for the contact arm portion 121*b* can be displaced according to the tension in the portions of tape 52 and ribbon 91 in contact with the contact arm portion 121*b*. Further, the pair urging portions 121*a* are in contact with the tape at different positions in the width direction of the tape, so that a uniform biasing force can be applied over the width of the tape, so that it is possible to ensure uniform and stable running of tape without being influenced by tape thickness fluctuations or accuracy errors of related components.

Now, the operation and function of the tape printer 1 having the above construction will be described.

First, the cassette cover 33 is removed, and then the release lever 34*a* (FIG. 2) is moved to the right to bring the platen holder 59 to the raised position, at which the platen 75 and driven feed roller 69 are separated from the thermal head 83 and drive feed roller 101, respectively. In this state, the tape cassette 35 is loaded in the cassette accommodation recess 31. As a result, the reel 95 is engaged with the take-up reel 85, and the drive feed roller 101 is engaged with the tape feeder 87. When the tape cassette 35 is loaded, an end portion of the thermal head 83 is found on the outer side of the cassette 35 with respect to a line connecting right ends 105*a* and 107*a* of the first and second guides 105 and 107. That is a portion of the ribbon 91 facing the platen 75 partly extends in the recess 103. However, when loading the tape cassette 35, the guide arm 111*b* of the coil spring 111 urges portions of the thermal transfer ribbon 91 and transparent tape 25 extending between the right end 105*a* of the first guide 105 and right end 107*a* of the second guide 107 outwardly of the line connecting these right ends 105*a* and 107*a*, so that a sufficient space for the advancement and retreat of the thermal head 83 into and out of the recess 103 is ensured. Thus, it is possible to prevent reliably the interference between the head 83 and tapes 91 and 25.

Thus, the tape cassette 35 can be loaded without possibility for the thermal head 83 to be caught by the thermal transfer ribbon 91 or transparent tape 25, thus eliminating the possibility of damage to or meandering of these tapes.

When the tape cassette 35 is loaded, the release lever 34*a* is moved to the left as shown by the arrow in FIG. 5. As a result, the function of the mechanism 34 is released, so that the platen holder 59 is moved to the operative position as shown in FIG. 5 by the biasing force of the leaf spring 61. At this time, the driven feed roller 69 is strongly urged against the drive feed roller 101 via the transparent tape 25 and double-sided adhesive tape 27. At the same time, the driven gear 71 (FIG. 6) of the feed roller assembly 73 is meshed with a drive gear (not shown) of the drive feed roller 101. Further, the platen 75 is urged against the thermal head 83 via the transparent tape 25 and thermal transfer ribbon 91. The platen bias spring 79 has an effect of establishing a timing relation that the platen 75 located at the lower end of the holes 67 turns to be urged against the thermal head 83 prior to the effecting of the forced contact between the driven and drive feed rollers 69 and 101.

However, since the biasing force of the platen bias spring 79 is set to be weaker than that of the leaf spring 61, the platen bias spring 79 is elastically deformed, and the shaft 75*b* of the platen 75 is retreated along the holes 67 to realize the forced contact between the two rollers 69 and 101 and the forced contact between the platen 75 and thermal head 83. Further, as it is elastically deformed according to the retreat of the platen 75, the platen bias spring 79 provides a biasing force to set up a constant spring contact force between the platen 75 and thermal head 83. Further, the platen 75 has its opposite ends biased independently by the respective arm portions 79*c* of the platen bias spring 79, an error that may be produced in the parallelness of the axis of rotation of the platen holder 59 and contact surface of the thermal head 83 (i.e., printing element 83*a*) can be compensated, so that the platen 75 is urged against the thermal head 83 reliably uniformly.

Stable and uniform printing thus can be obtained without being adversely affected by accuracy errors of the printing head 83, platen holder 59 and related components.

Further, with the movement of the platen holder 59 to the operative position, the bent portion 11*a* of the coil spring 111 is pushed down to the position shown in FIG. 5 in contact with the spring pushing piece 81. As a result, the ribbon guide arm 111*b* is brought to a position on the inner side of the line connecting the right ends of the first and second guides 105 and 107, so that it is no longer effective. That is, it will never interfere with the operation of urging the platen 75 against the thermal head 83 or have any adverse effect on the running of the thermal transfer ribbon 91, while the contact of the tapes 91 and 25 with the head 83 is permitted.

By the above function, the tape printer 1 is rendered ready for printing.

In this state, input characters are stored in the internal memory by operating the character selection dial 5 and determination key 7, and the print key 17 is operated. As a result, the stepping motor is rotated, and the printing element 83*a* is driven to emit head to effect printing.

When the stepping motor is driven, the tape feeder 87 is rotated in the clockwise direction in FIG. 5. As a result, the drive feed roller 101 is rotated in the clockwise direction to cause rotation of the driven feed roller 69 in the counterclockwise direction via the drive and driven gears. The transparent tape 25 and double-sided adhesive tape 27 between the two rollers 69 and 101 are thus fed out of the opening 99 (i.e., to the right in FIG. 5) while they are applied to each other.

When the stepping motor is driven the take-up reel 85 is rotated in the counterclockwise direction in FIG. 5. While the thermal transfer ribbon 91 and transparent tape 25 are pinched between the platen 75 and thermal head 83, the frictional force acting between the ribbon 91 and tape 25 at this position is greater than the take-up force of reel 95, to which the rotation of the stepping motor is transmitted through the slip mechanism. Thus, the amount of thermal transfer ribbon 91 taken up on the reel 95 is limited by the frictional force noted above, and it is equal to the amount of the transparent tape 25 fed by the drive and driven feed rollers 101 and 69 and passing through between the thermal head 83 and platen 75. In other words, the amount of feed of the transparent tape 25, thermal transfer ribbon 91 and double-sided adhesive tape 27 is governed by the amount of rotation of the two feed rollers 101 and 69.

The print image 29 is formed on the transparent tape 25 via the thermal transfer ribbon 91 fed in this way, as shown in FIG. 3. The printing process is the same as in the well-known thermal printer except that the printed pattern is reversed left to right, so it is not described in detail.

The transparent tape 25 and thermal transfer ribbon 91 fed by the two rollers 101 and 69 are given back tension by the action of the pair urging portions 121*a* of the back tension spring 121. Thus, the tape 25 and ribbon 91 are not excessively paid off. Also, the meandering of the tape 25 and ribbon 91 is prevented with the displacement of the contact arm 121*b* according to the back tension.

The tape 21, which has been produced with formation of a print image on the transparent tape 25 and subsequent application thereto of the double-sided adhesive tape 27, is fed to an extent necessary for the cutter 49 to pass above the finally printed character image, and then the cutter lever 45 is turned to cut the tape with the cutter 49. The cut tape is taken out and used for general display or as a label.

For unloading the tape cassette after printing, the release lever 34 is moved to the right in FIG. 5. As a result, the platen holder 59 is moved to the inoperative position shown in FIG. 4, thus causing elastic restoration of the coil spring 111. The ribbon guide arm 111*b* thus urges the tape 91 outwardly of the recess 103 to ensure the space, into and out of which the thermal head 83 is advanced and retreated. Thus, the tape cassette 35 can be smoothly removed.

As is apparent from the above description, the transparent tape 25 is with the double-sided adhesive tape 27 applied to it in its portion from the position cut by the cutter 49 to the position corresponding to the drive feed roller 101. However, since one of the two feed rollers as feed roller means is provided in the tape cassette 35, the tape cassette 35 can be loaded and unloaded without need of any cumbersome operation of passing the tape lamination through the feed roller means. This embodiment of the tape cassette 35 thus can be handled very easily.

Further, if different amounts of sagging of the transparent tape 25 and thermal transfer ribbon 91 are produced due to some cause so that it becomes necessary to pull out the tape 25 and ribbon 91 independently, the necessity can be fulfilled without causing contamination of these tapes by virtue of presence of the separator film 117. Particularly, while an urging force is applied to the transparent tape 25 and thermal transfer ribbon 91 at the guide pin 113 by the urging portions 121*a* of the back tension spring 121, occasional transfer of the ink of the thermal transfer ribbon 91 to the transfer tape 25 is prevented by the separator film 117 even if the tape cassette is stored at a high temperature for long time.

Second embodiment of the invention will now be described with reference to FIGS. 9 to 12.

In this embodiment, the tape printer has the same appearance as that of the first embodiment shown in FIGS. 1 and 2, so it will not be shown.

Figure 9:
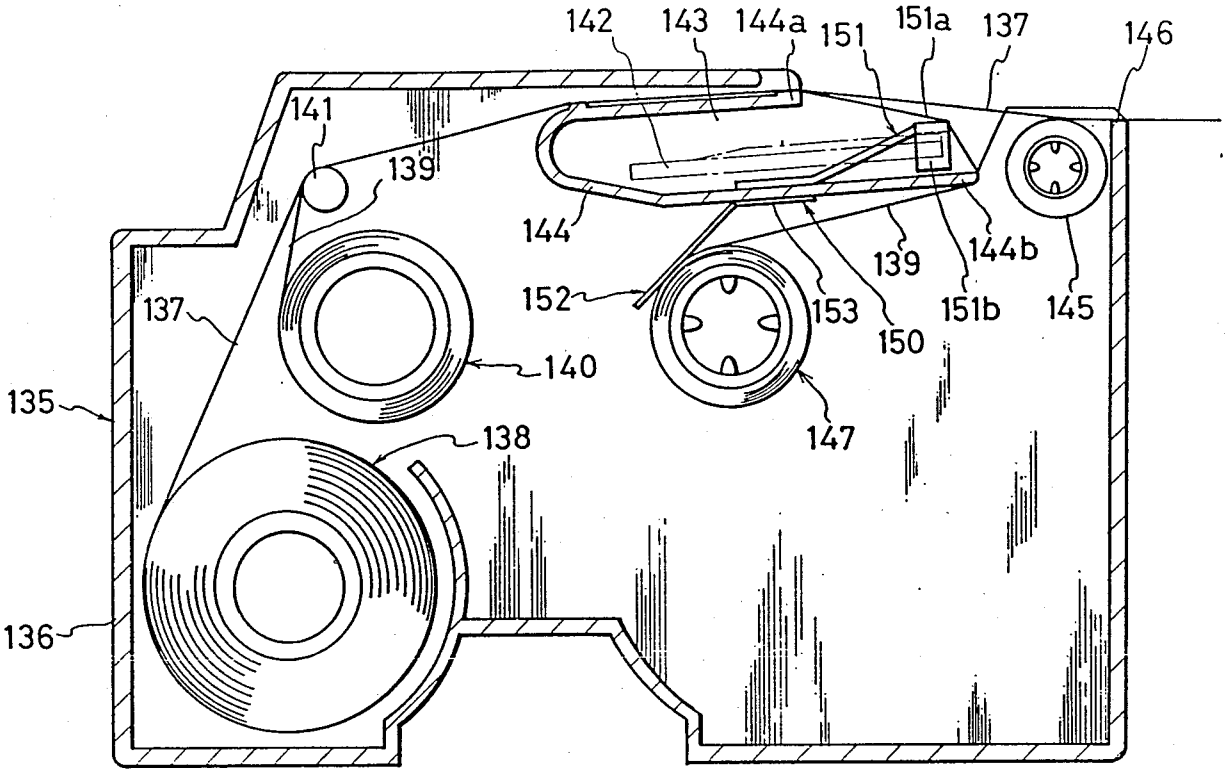
FIG. 9 is a sectional view showing a tape cassette as a second embodiment of the invention.

FIG. 9 shows a tape cassette in this embodiment. In the tape cassette 135, a reel 138 for supplying a printing tape 137 as an image receiving tape and a reel 140 for supplying an ink ribbon 139 as an image source tape are rotatably supported by respective reel holders provided in the cassette housing 136. A guide roller 141 for guiding the tape and ribbon is provided rotatably ahead of the two reels in the path of running of the tape and ribbon. A recess 3 is provided ahead of the guide roller 141 in the running path such that a thermal head 142 secured to the frame of the tape printer 130 can be advanced into it when loading the tape cassette 135. The recess 143 is defined by a J-shaped wall 144 of the tape cassette 135. The J-shaped wall 144 has one end 144*a* for guiding both the printing tape 137 and ink ribbon 139 and the other end 144*b* for guiding the ink ribbon 139.

A feed roller 145 is provided rotatably ahead of the J-shaped wall 144 in the path of running of the printing tape 137. The feed roller 145 is capable of being engaged with a roller driver 162, to be described later, provided in the tape printer 130 at a predetermined position. The torque of the roller driver 162 is transmitted to the feed roller 145. As the feed roller 145 and pinch roller 155, to be described later, provided in the tape printer 130 are rotated, the printing tape 137 pinched between these rollers is fed toward a tape outlet 146.

Figure 10:
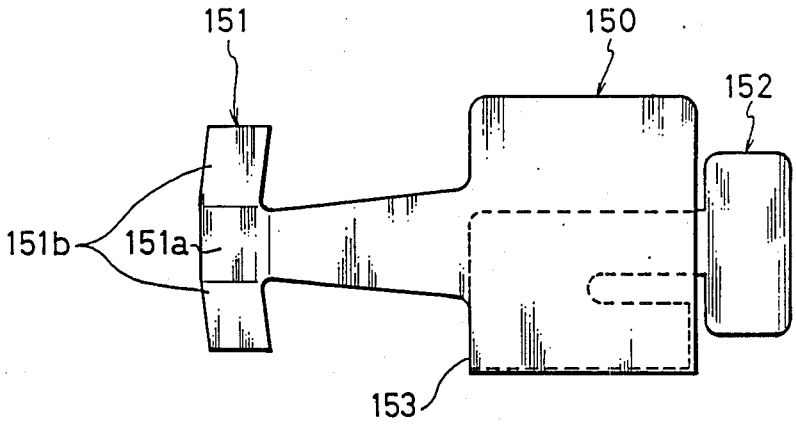
FIGS. 10 and 11 are respectively a plan view and a perspective view, to an enlarged scale, showing a leaf spring member in the same tape cassette.
Figure 11:
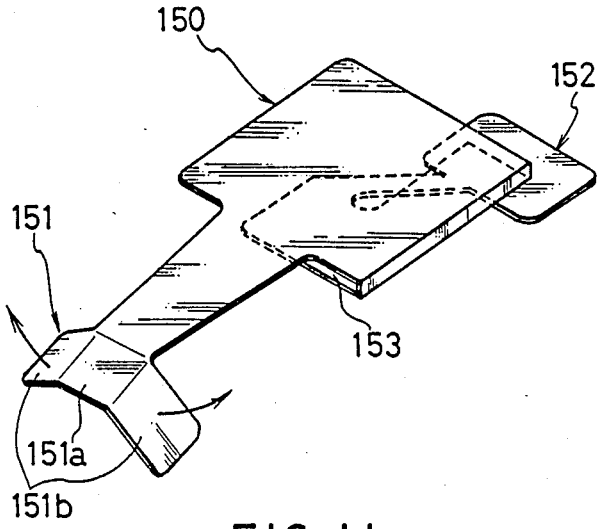

A take-up reel 147 for taking up the ink ribbon 139 thereon is provided ahead of the rollers 145 and 155 in the path of running of the ink ribbon 139 guided by the end 144*b*. The take-up reel 147 is engaged with a reel driver 161, to be described later, provided in the tape printer 130 at a predetermined position thereof and receives torque of the reel driver 161. As the take-up reel 147 is rotated, the ink ribbon 139 paid off the reel 140 is caused to run along a predetermined path and be taken up on the reel 147. A leaf spring 150 is mounted on the J-shaped wall 144 at a predetermined position thereof. FIG. 10 is a plan view showing a leaf spring member 150, and FIG. 11 is a perspective view thereof. As is obvious from FIGS. 10 and 11, the leaf spring member 150 has a first spring portion 151, a second spring portion 152 and a mounting portion 153, these portions being elastically deformable. The first portion 151 has an intermediate portion 151*a* and opposite wing portions 151*a*. The leaf spring member 150 is mounted in the tape cassette 135 by securing the mounting portion 153 to the J-shaped wall 144 as shown in FIG. 9, the first spring portion 151 is disposed in the recess 143, and the second spring member 152 is engaged with the take-up reel 147 and located at a position to provide a back tension in the take-up operation. As a result, the ink ribbon 139 guided by the ends 144*a* and 144*b* of the J-shaped wall 144 is also guided by the intermediate portion 151*a* of the first spring member 151 of the leaf spring member 150. Therefore, when the tape cassete 135 is removed from the tape printer 130, it is held in the running path so that it will not interfere with the advancement of the thermal head 142.

Now, the construction of the printing mechanism of the tape printer 130 will be described with reference to FIG. 12.

Figure 12:
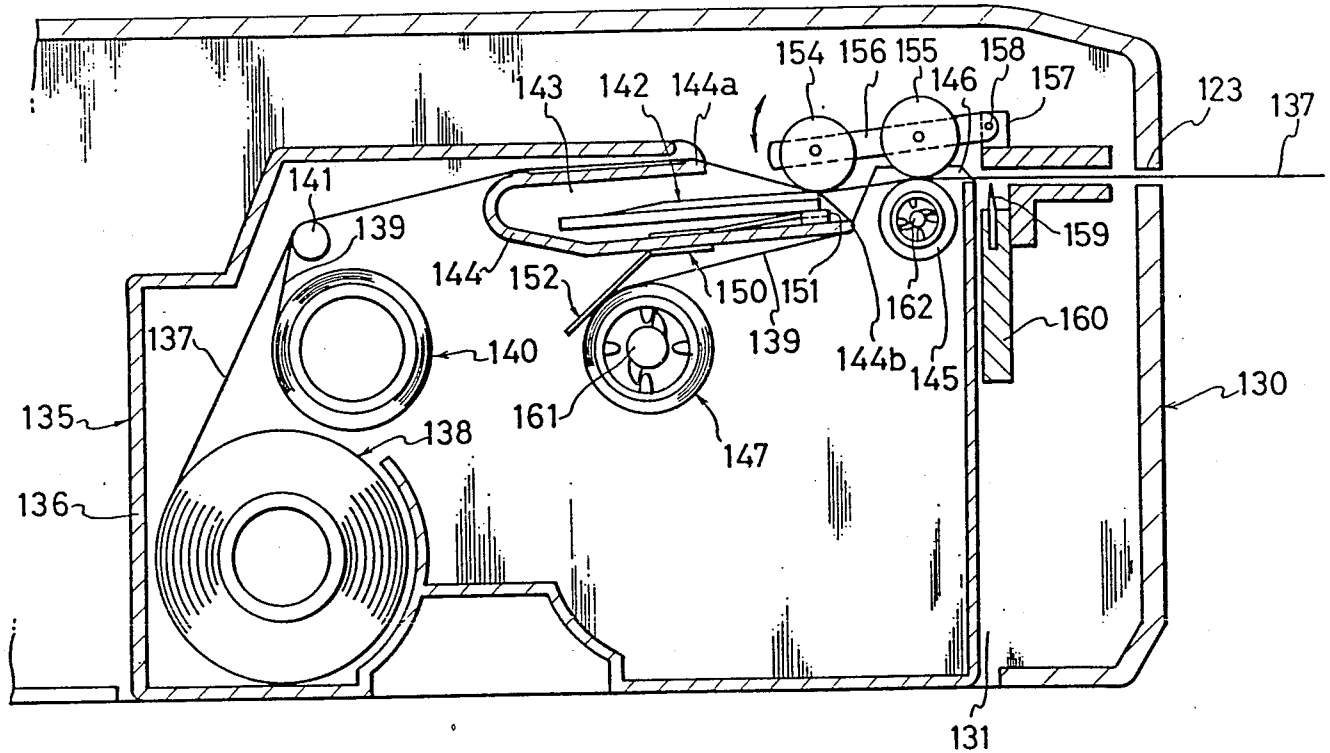
FIG. 12 is a sectional view showing the same tape cassette together with a tape printer in a state corresponding to FIG. 2.
Figure 13:
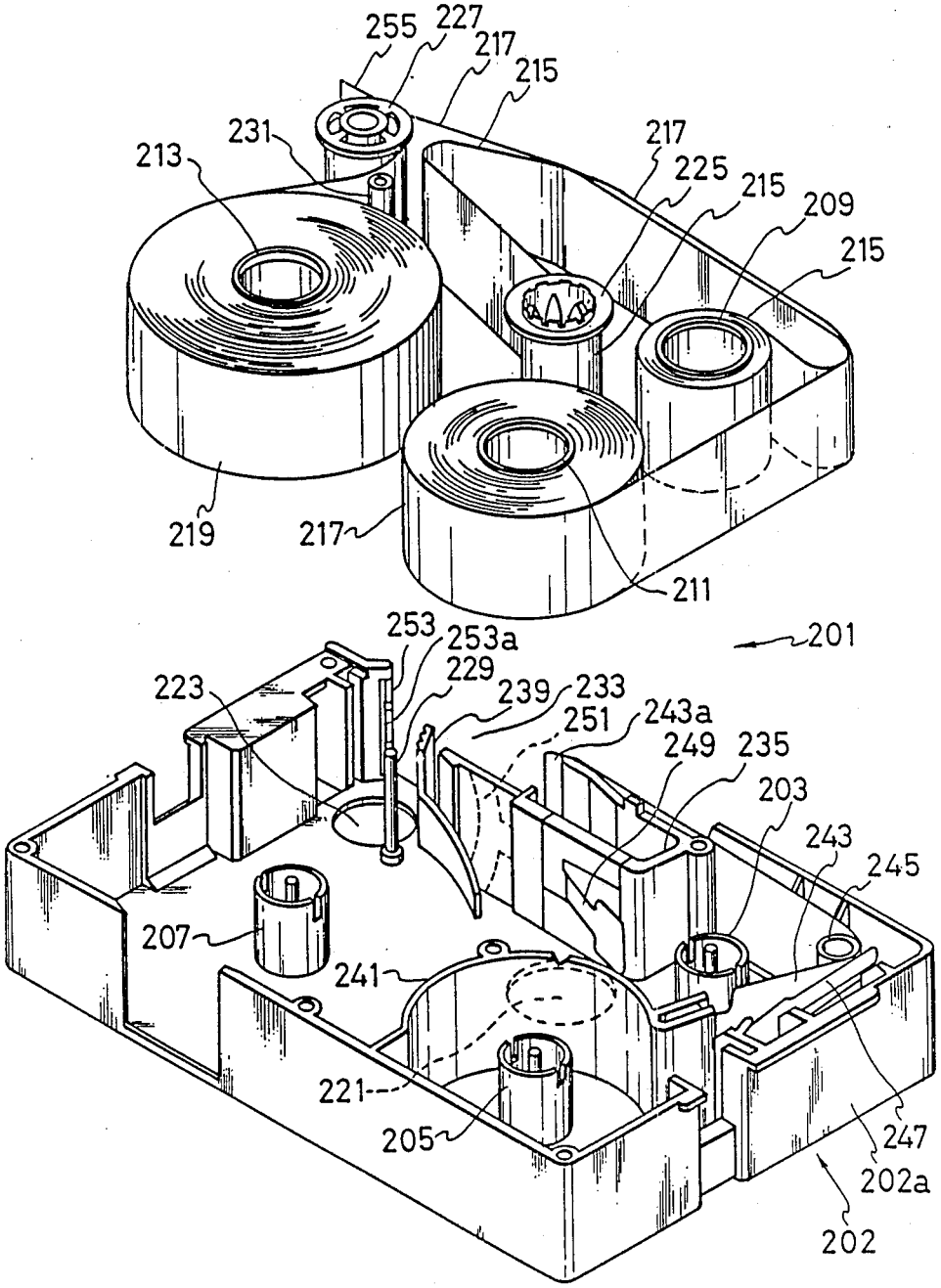
FIG. 13 is an exploded perspective view showing a label tape cassette as a third embodiment of the invention.
Figure 14:
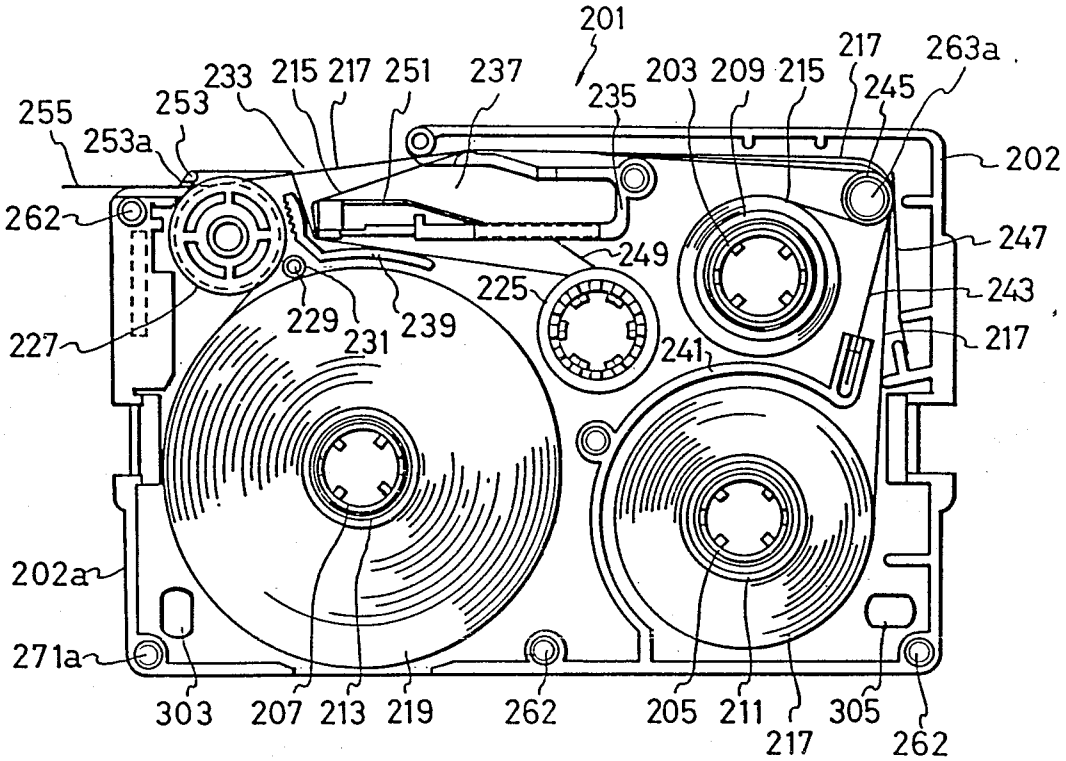
FIG. 14 is a sectional plan view showing the same label tape cassette with a housing cover removed.

FIG. 12 shows the tape cassette 135 shown in FIG. 9 mounted in the cassette accommodation recess 131 of the tape printer 130. In the cassette accommodation recess 131 of the tape printer 130, the thermal head 142 is disposed at a position corresponding to the recess 143 of the tape cassette 135. Near the cassette accommodation recess 131, a platen holder 157 is provided to rotatably support the platen holder 156. In the platen holder 156, a platen 154 and a pinch roller 155 are rotatably supported. The platen 154 is urged against the thermal head 142 via the printing tape 137 and ink ribbon 139. The pinch roller 155 is ruged against the feed roller 145 via the printing tape 137.

The rollers 154 and 155 are brought into contact with each other and separated from each other by sliding of a release lever, which is not shown but is similar to the release lever 34*a* in the first embodiment. When the release lever is operated, the platen holder 156 is rotated in either of the directions of arrows via a drive mechanism (not shown) to bring the platen 154 and pinch roller 155 into contact with each other or separate the two from each other.

In the tape printer 130, a cutter for cutting a printed tape is supported by a cutter support 160 near the tape outlet 146 of the tape cassette 135. The cutter support 160 is operatively coupled to a cutter lever (not shown) similar to the cutter lever 45 of the first embodiment.

In the cassette accommodation recess 131 a reel driver 161 and a roller driver 162 are disposed at a positions corresponding to the take-up reel 147 and reed roller 145, respectively. These drivers 161 and 162 are coupled to drive motors (not shown) provided in the tape printer 130, and the torques of the drive motors are transmitted to the take-up reel 147 and feed roller 145.

The printing operation performed by loading the tape cassette in the tape printer having the above construction is like that described before in connection with the first embodiment, so its description is not given.

Now, the function of the leaf spring member 150 when loading the tape cassette 135 in the tape printer 130 will be described.

Before the leaf spring member 150 is mounted in the tape printer 130, it has a shape as shown in FIG. 9, with the intermediate portion 151*a* of the first portion 151 is located at an operative position, i.e., a position, at which the ink ribbon 139 can be guided by the intermediate portion 151*a* to a path not interfering with the advancement of the thermal head 142.

When the tape cassette 135 is loaded in the tape printer 130, the thermal head 142 begins to advance into the recess 143 of the tape cassette 135. At this time, a portion of a member supporting the heat emitting element of the thermal head 142 is brought into engagement with the inclined surface of one of the wings 151*b* of the first spring portion 151 of the leaf spring member 150 disposed in the recess 143 of the tape cassette 135. As the thermal head 142 is further advanced after this engagement is obtained, the first spring portion 151 of the leaf spring member 150 is elastically deformed by the thermal head 142.

More specifically, the inclined surfaces of the two wings 151*b* are pushed away from each other as shown by arrows in with the advancement of the thermal head 142, thus reducing the level of the intermediate portion 151*a* from the J-shaped wall 144 as shown in FIG. 9. With this elastic deformation, the intermediate portion 151*a* is brought to an inoperative position retreated from the operative position noted above. The inoperative position is one, at which the intermediate portion 151*a* has no guiding function with respect to the ink ribbon 139 at all.

During the displacement of the first spring portion 151 from the operative position to the inoperative position, the thermal head 142 is brought to a position between the intermediate portion 151*a* and the path of the ink ribbon 139. As a result, the path of the ink ribbon 139 is found on the outer side of the thermal head 142, i.e., on the side of the platen 154, as shown in FIG. 12. Further, with the platen 154 urged against the thermal head 142, the ink ribbon 139 and printing tape 137 are pinched between the thermal head 142 and platen 154 to be ready for thermal transfer printing.

The leaf spring member 150 serves to guide the path of the ink ribbon 139 and facilitates advancement of the thermal head 142. With the engagement of the second spring portion 152 of the leaf spring member 150 with the reel 147, on which the ink ribbon 139 is taken up, abpack tension is given to the running of the ink ribbon 139. Thus, there is no need of providing any particular member for providing back tension, and it is possible to reduce the number of components used.

While the tape cassette of this embodiment accommodates the printing tape 137 as image receiving tape and ink ribbon 39 as image source tape, the invention is also applicable to an ink ribbon cassette, which accommodates a sole ink ribbon.

Now a tape cassette and a tape printer as a third embodiment of the invention and their modifications will be described with reference to FIGS. 13 to 22.

Figure 17:
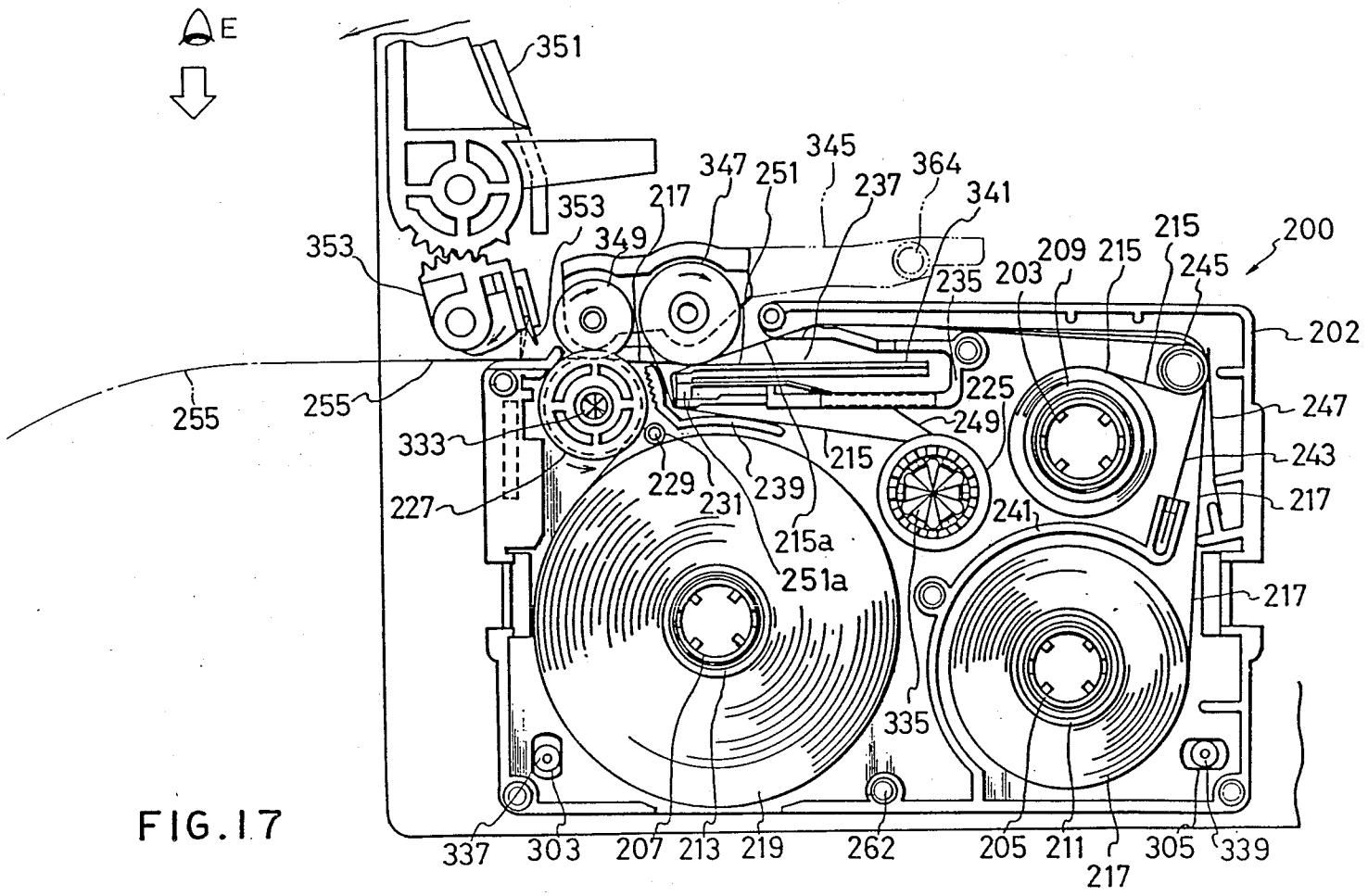
FIG. 17 is a sectional view showing the same label tape cassette together with a tape printer in a state corresponding to FIG. 2.

FIGS. 13 to 16 show a label tape cassette 201, and FIG. 17 shows a tape printer 200 with the tape cassette 201 loaded therein. Referring to FIGS. 13 to 16, in a cassette housing 202 three cylindrical posts 203, 205 and 207 extend upright from the bottom. Reels 209, 211 and 213 are rotatably supported on the respective posts 203, 205 and 207. On the reel 209 a thermal transfer ink ribbon 215 before printing is wound with the ink surface on the inner side. On the reel 211 a transparent printing tape 217 is wound. On the reel 213 is wound a double-sided adhesive tape 219, on one surface of which a separable sheet is wound, with the separable sheet on the inner side. The bottom of the cassette housing 202 is formed with holes 221 and 223, in which ends of a ribbon take-up reel 225 and a tape feed foller 227 are rotatably supported.

The cylindrical post 203 and bearing hole 221 constitute an ink ribbon accommodation section, the cylindrical post 205 constitutes a printing tape accommodations section, and the cylindrical post 207 constitutes an adhesive tape accommodation section.

The neighborhood of the bearing hole 223 has the following arrangement. On a support shaft 229 an adhesive tape roller 231 consisting of silicone rubber is rotatably supported. The casing 202 has a roller entrance 233 formed by forming a notch in the peripheral wall 202*a*. A roller part, to be described later, of the tape printer 200 can enter the cassette housing 202 through the roller entrance 233. The inner side of the roller entrance 233 corresponds to a printing section. A substantially J-shaped wall 235 is provided in the depth of the roller entrance 233. The wall 235 defines a recess 237, into which the printing head 341 secured to the tape printer 200 can enter. The recess 237 has an open bottom so that the head 341 can enter it. A partition wall 239 is provided between the wall 235 and support shaft 229. The partition wall 239 serves to prevent direct contact of the ink ribbon 215, which can be readily bent, and the adhesive surface of the double-sided adhesive tape 219 with each other.

Around the cylindrical post 205, an arcuate printing tape accommodation wall 241 is provided to surround the printing tape accommodation section. A stem of a separator film 243 is secured to an end 241*a* of the wall 241. The separator film 243 is guided by a guide shaft 245 provided near the cylindrical shaft 203, and its end portion slightly extends in the roller entrance 233, which constitutes a printing area. A back tension spring 247 is provided on a peripheral wall portion 202*a* of the housing near the roller entrance 233. The back tension spring 247 provides an urging force toward a guide pin 245 to let the ink ribbon 215, separator tape 243 and printing tape 217 be pinched between it and the guide pin 245, thus providing independent back tensions to the ink ribbon 215 and printing tape 215.

The construction and function of the back tension spring 247 are substantially as described in connection with the previous embodiment with reference to FIG. 7.

Another back tension spring 249 is provided on the outer surface of the peripheral wall 35 to provide a back tension to the ink ribbon 215 wound on the reel 225, thus preventing the loosening of the ink ribbon 215 prior to the loading in the tape printer 200 in co-operation with the back tension spring 215. On the inner surface of the peripheral wall 235 a ribbon tension spring 251 is provided as tape-biasing means integrally with the spring 247. Thus, prior to the loading of the tape cassette 201 in the tape printer 200 the ink ribbon 215 is held in a raised position so that it will not interfere with the insertion of the printing head. This spring is similar in function as that described before in connection with the previous embodiment with reference to FIGS. 10 and 11. A tape retainer 253 is provided on the outer surface of the peripheral wall 202*a* near the tape feed roller 227, forming with the peripheral wall 202*a* a slit 253*a*, through which the tape can pass.

The path of the ink ribbon 215 extends from the reel 209 through between the separator 243 and guide pin 245 and between the peripheral wall 202*a* and wall 235 to the roller entrance 233. At this point, its direction is changed by about 180 via the ribbon tension spring 251, and it extends through between the peripheral wall 235 and partition wall 239 to the take-up reel 225.

Figure 15:
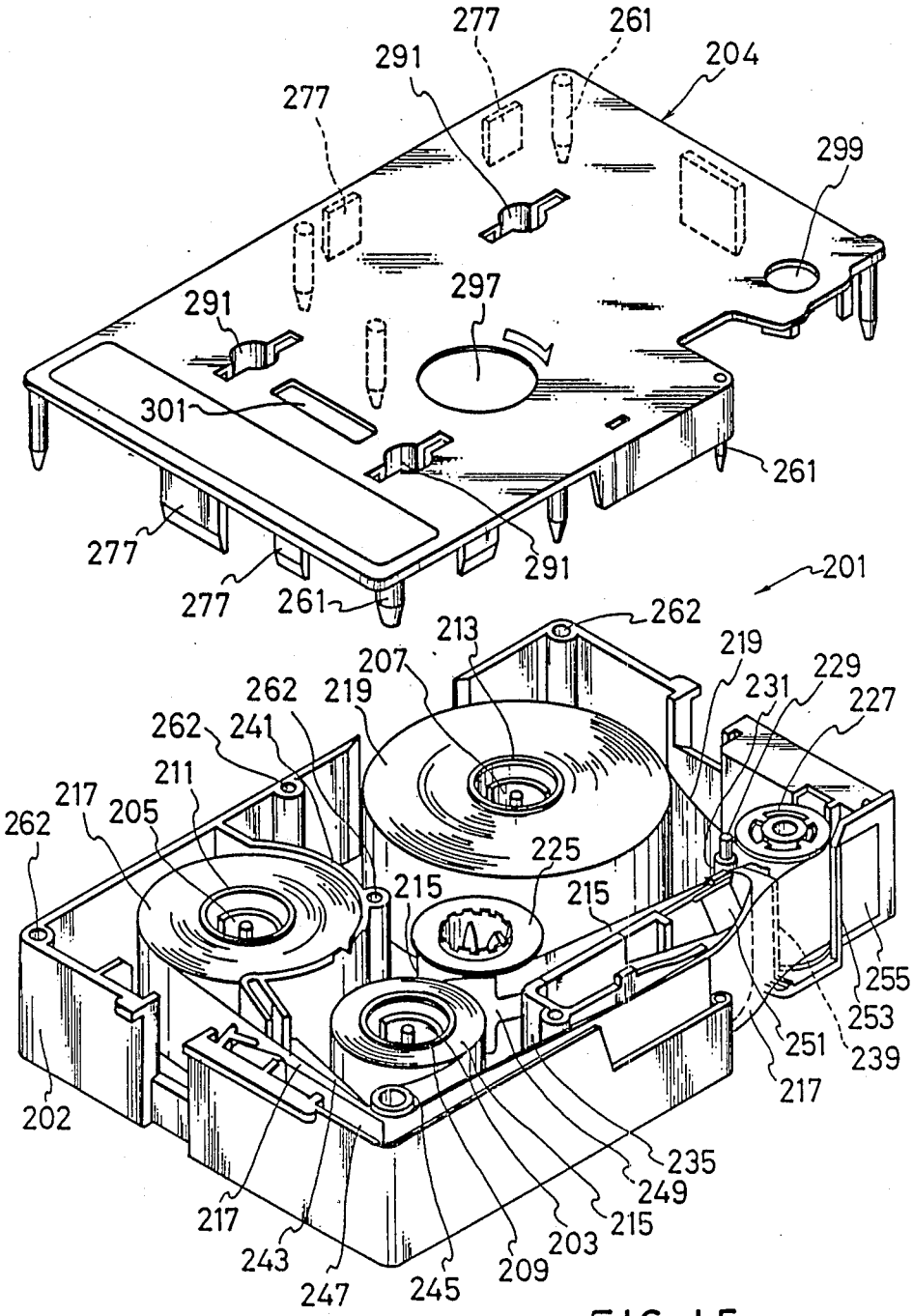
FIG. 15 is an exploded perspective view showing the same label tape cassette viewed from the side opposite the side of FIG. 13.
Figure 16A:
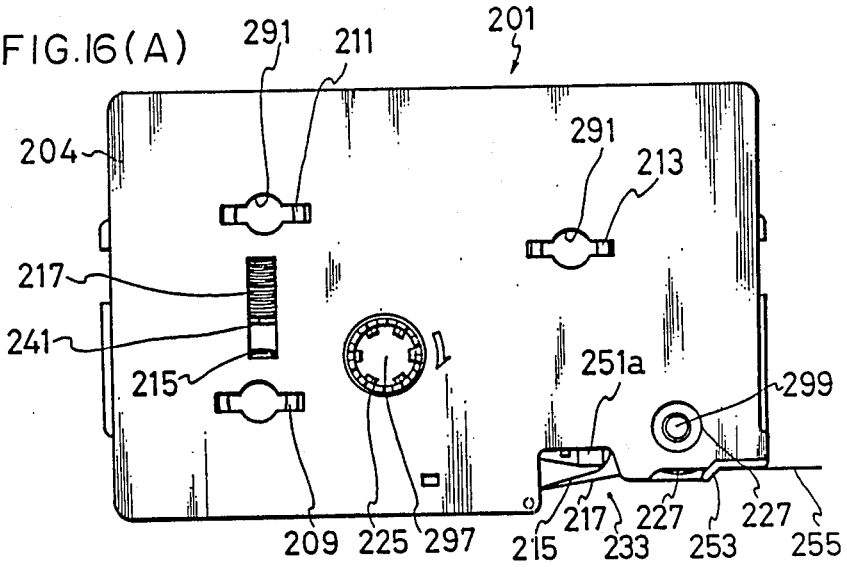
FIGS. 16(A), 16(B) and 16(C) are respectively a plan view, a front view and a bottom view showing the same label tape cassette.
Figure 16B:
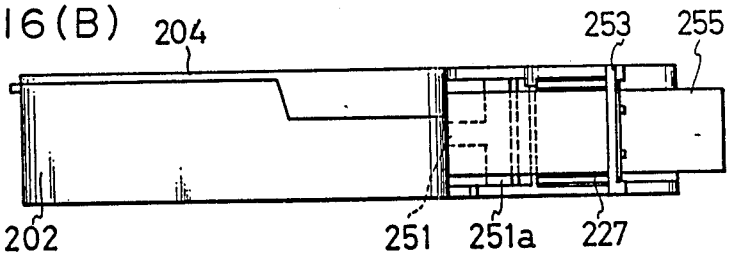
Figure 16C:
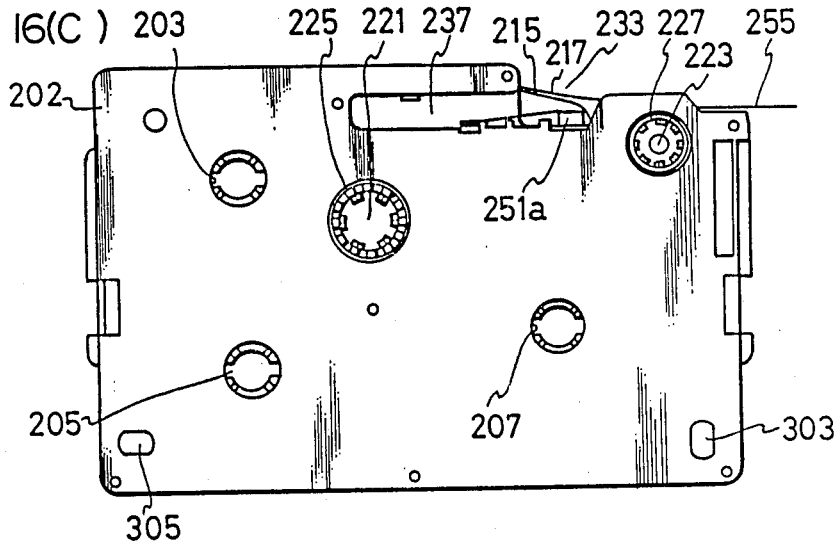

The path of the printing tape 217 extends from the reel 211 through between the separator 243 and spring 247 and between the peripheral wall 202*a* and wall 235 to reach the roller entrance 233. From this point, it extends round the tape feed roller 227 and through the slit 253*a* to the outside. When the printing tape 217 passes round the feed roller 227, it is applied to the adhesive surface of the double-sided adhesive tape 219 paid off the reel 213, so that a label tape 255 is produced, which is fed out to the outside. As shown in FIG. 15, a cassette cover 204 is mounted on the cassette housing 202, which has the above structure and accommodates the various components as described above. The cassette cover 204 has a plurality of legs 261, which are fitted in respective holes 262 formed in the cassette housing 202, whereby the cassette cover and housing 204 and 202 are secured to each other. At this time, a plurality of plate-like projections 277 depending from the cassette cover 204 are urged against the inner surface of the peripheral wall 202*a* of the housing 202 to ensure reliable securement of the cover 204 and housing 202 to each other.

Further, cylindrical posts 291 of the cover 204 are fitted in the respective cylindrical posts 203, 205 and 207 of the housing 202. The reel 225 has its upper and supported in a bearing hole 297 of the cover 204, and the feed roller 227 has an upper end rotatably supported in a bearing hole 299 of the cover 204.

The cover 204 has a window 301, through which the residual amounts of the printing tape 217 and ink ribbon 215 can be confirmed. The bottom of the housing 202 has slots 303 and 305 for the purpose of positioning the tape cassette 201 when the same is loaded in the tape printer 200.

The loading of the tape cassette 201 in the tape printer 200 and operation thereof will now be described with reference to FIG. 17.

When loading the tape cassette 201, the feed roller drive shaft 333 on the side of the tape printer 2000 is fitted in the tape feed roller 227 on the side of the tape cassette 200, the ribbon take-up reel drive shaft 335 on the tape printer side is fitted in the ribbon take-up reel 225 on the tape cassette side, and the positioning projections 337 and 339 on the tape printer side are received in the slots 303 and 305. At this time, the printing head 341 secured to the tape printer 200 at a predetermined position thereof is advanced into the head insertion recess 234 from the back side of the tape cassette 201.

When the printing head 341 is advanced into the recess 237, its end strikes the inclined surfaces 251*a* of the ribbon tension spring 251 to cause deformation thereof to the side opposite the ink ribbon. After the head 341 is sufficiently advanced into the recess 237, a portion 215*a* of the ink ribbon 215 that faces the platen 347 is separated from the spring 251. Thus, the head 341 is advanced into the recess without possibility for the ink ribbon 215 to be caught by its end.

Then, the platen holder 345 is turned about its support shaft 343 via the drive mechanism to be described later provided on the tape printer 200. In consequence, the platen 347 and feed roller 349 are partly advanced into the roller entrance 233 as shown in FIG. 17.

The platen 347 advanced into the tape cassette 201 overlaps the printing tape 217 and ink ribbon 215 found in the roller entrance 233 and urges then against the end of the printing head 341, in which there is the heat-emitting element.

On the left side, the feed roller 349 is urged against the feed roller 277 on the side of the tape cassette 201 to cause the printing tape 217 to be overlapped over and applied to the double-sided adhesive tape 219 in co-operation with the feed roller 227.

In this state, a printing operation is executed by operating the tape printer 200. At this time, a drive mechanism (not shown) on the side of the tape printer 200 is operated to cause rotation of the drive shafts 333 and 335. At the same time, a print drive circuit (not shown) causes the heating-emitting element of the printing head 341 to emit heat according to a printing pattern.

The heat-emitting element of the printing head 341 consists of a plurality of elements arranged in a row extending perpendicular to the direction of feed of the printing tape 217. The print drive circuit like the ordinary thermal printer, gives the heat-emitting element a printing pattern sequentially from the left end of a vertical dot row in a matrix pattern just like the order of printing a positive image. However, since the relative scanning direction between the printing head 341 in the tape printer 200 and printing tape 217 is converse to the scanning direction of the ordinary thermal printer, the printing pattern that is formed is a mirror image when the printing tape 217 is viewed from the side of the printing surface.

When the drive shaft 333 is driven, the feed roller 227 co-operates with the drive feed roller 349 to bond together the printing tape 217 and double-sided adhesive tape 219 to discharge the resultant lamination as label tape 255 to the outside of the tape printer 200 as shown by a phantom line. At this time, the printing tape 217 and double-sided adhesive tape 219 are simultaneously paid off the respective reels 211 and 213. The operator can see the printing tape 217 of the label tape 255 as shown by arrow E.

Meanwhile, with the rotation of the drive shaft 335 the ribbon take-up reel 225 takes up the ink ribbon 215, whereby the ink ribbon 215 is paid off the reel 209 substantially at the same speed as the speed of the printing tape 217.

With the above operation of the above drive shafts 333 and 335 the printing tape 217 and ink ribbon 215 are run in the overlapped state past the pinching position between the platen 347 and printing head 341.

Thus, at the pinching position ink of the ink ribbon 215 is attached to the printing tape 217 in accordance with a heat generation pattern of the heat-emitting element. In this state, the printing tape 217 is laminated with the double-sided adhesive tape 219. The double-sided adhesive tape 219 is applied to the side of the printing tape 217 with the printing pattern. Thus, the discharged label tape 255 has a structure as shown in FIG. 2. The bottom of the printing tape 217 is formed with a mirror image printing pattern 255*a* of the ink of the ink ribbon 215. On this surface the adhesive tape 219*a* of the double-sided adhesive tape 219 is applied, and the lowermost layer of the label tape is constituted by the separable sheet 219*b* of the double-sided adhesive tape 219.

After the printing is completed, the cutter lever 351 provided in the tape printer 200 is turned on the direction of the arrow in FIG. 17 to cause rotation of the rotary cutter 353 in the interlocked relation. As a result, the cutter 353*a* cuts the discharged label tape 255 by urging the tape 255 against the outer surface of the peripheral wall 202 of the tape cassette 201.

When the label tape 255 thus produced is applied to an intended place by separating the separable sheet 219*b*, the print is not on the front side but on the back side. Since the printing pattern is a mirror image, it is a positive image when viewed from the front side. In addition, the printing surface is protected by the printing tape 217, so that it is possible to obtain a highly durable label display.

Now, the mechanism 360 of moving the platen holder 345 between the operative positive shown by solid line in FIG. 17 and inoperative position above the operative position will be described with reference to FIGS. 18 and 19.

The mechanism 360 is rotatably supported on the tape printer frame 362 via a support shaft 364 and can drive the platen holder 345 carrying the platen 347 and feed roller 349 between the inoperative position shown by solid line, at which it is held by the spring 365 wound on the support shaft 364, and the operative position shown by the phantom line. To this end, a slider 366 is provided, which is movable in the direction of arrow from the position of the solid line to the position of the phantom line and in the opposite direction, and its engagement end 366*a* faces a tapered cam surface 368 of the platen holder 366. The slider 366 is slidably guided along the top surface 362*a* of the frame 362.

The slider 366 has a stem 366*b* pivoted by a pivot 374 to the operating lever 372 rotatably mounted on a support shaft 370 on the frame 362 as shown in FIG. 19. The lever 372, like the lever 34*a* in the previous embodiment, projects to the outside of the tape printer so that it is operable by the operator.

When the lever 372 is operated from the position of the solid line to the position of the phantom line in the direction of the arrow in FIG. 19, the slider 366 is moved to the left as shown by the arrow. The slider 366 thus is moved to the left from the position of the solid line to the position of the phantom line in FIG. 18, so that the engagement end 366*a* is brought into contact with the taper can surface 368 of the platen holder 345. With the action of this cam the platen holder 345 is turned to the operative position shown by the phantom line against the spring force of the spring 365.

When the lever 372 is switched to the position of the solid line in FIG. 19, the slider 366 is also returned, so that the platen holder 345 is returned by the spring 365 to the inoperative position shown by the solid line.

Although not shown, a click mechanism or like means is desirably provided to hold the lever 372 at the two switchable positions with frictional force.

Figure 20:
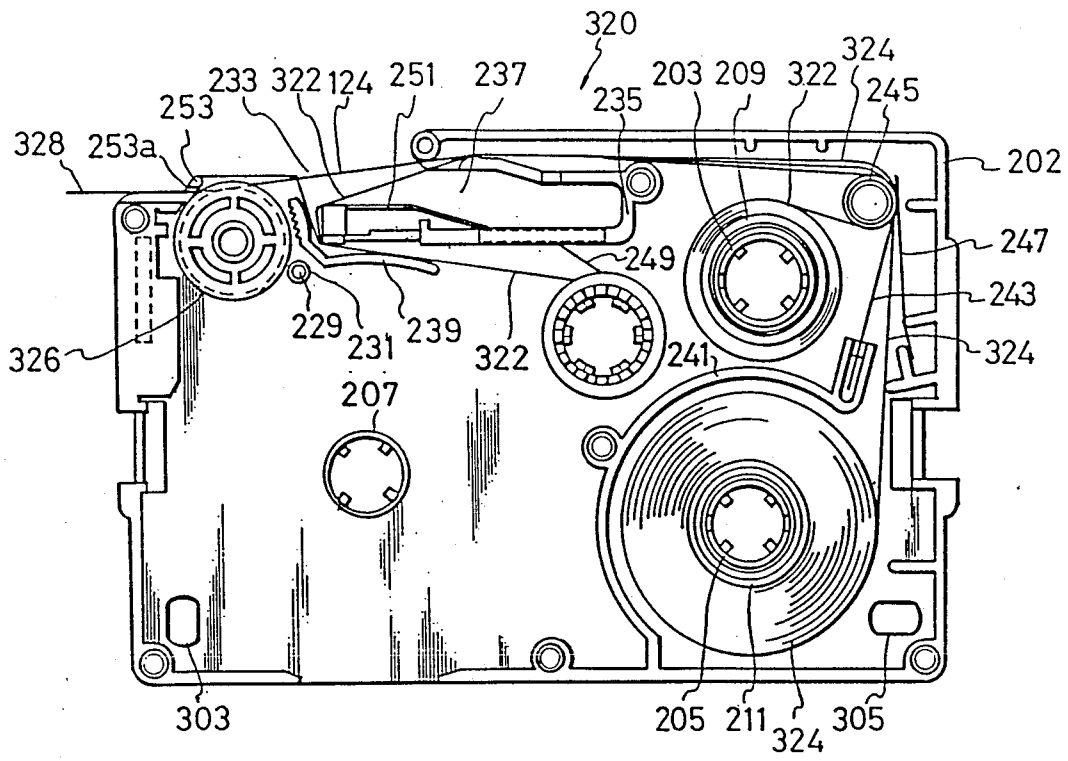
FIG. 20 is a sectional view showing a lettering tape cassette using the same cassette housing shown in FIGS. 13 to 16 in a state corresponding to FIG. 14.

FIG. 20 shows a modification of tape cassette 320, which is constructed for lettering by using the same cassette housing 202 and cover 204. This tape cassette is different from the preceding label tape cassette 201 as follows. (1) it uses a lettering ink ribbon 322 and a printing tape 324. (2) Neither double-sided adhesive tape 219 nor reel 213 therefor is provided on the cylindrical post 207. (3) The feed roller 326 has a convex axial sectional profile, so that it leads the printing tape 324 to the outside in contact not with the printing surface but with the edges. Thus, the same cassette housing structure consisting of the cassette housing 202 and cover 204 may be used for the label tape cassette 201 and also for the lettering tape cassette 320.

With this structure, a lettering transfer tape 328 is produced and fed to the outside through a slit-like tape outlet 328.

The difference when the lettering tape cassette 320 is loaded in the tape printer 200 shown in FIG. 17 are (1) that the double-sided adhesive tape 219 and printing tape 217 are not laminated at the pinching position between the feed roller 227 and drive feed roller 349 and (2) that a lettering transfer tape 328 that is produced as a structure as shown in FIG. 22. The other construction and function are the same as in the previous case of the label tape cassette. Therefore, detailed description is omitted, and like parts are designated by like reference numerals. In the produced lettering transfer tape 328, a mirror image printing pattern **328*a* of transfer tape 328, a mirror image printing pattern 328*a* of transfer ink is formed on the back side of the printing tape 324. Thus, a positive image printing pattern can be transferred to an intended plate by holding the side of the printing pattern 328*a* against the place and rubbing the tape 328** from above.

In the case of the label tape 255 produced with the label tape cassette 201 and also the case of the lettering transfer tape 328 produced with the lettering tape cassette 320, the print pattern formed on the printing tapes 217 and 324 is displayed as a converse display on the object, to which the pattern is applied and transferred. Thus, there is no need of switching the printing mode of the tape printer 200 for the two different types of tape cassettes. In other words, it is possible to eliminate the waste in material and operation that might otherwise result from effecting printing by neglecting the switching and subsequently perfoming the printing operation afresh by switching modes.

What is claimed is:

1. A tape cassette for being detachably loaded in a tape printer having a frame, a printing head, a platen and tape driving means, said printing head and platen being provided in a printing area in said-frame, said printing head and said platen being relatively movable between an inoperative position, at which they are spaced apart, and an operative position, in which they are in contact with each other to perform a printing operation, comprising:

a housing with a tape outlet;

first to third accommodating sections provided in said housing;

an image source tape accommodated in said first accommodating section and driven by said tape driving means between said printing head and platen;

a substantially transparent image receiving tape accommodated in said second accommodating section, driven by said tape driving means in an overlapped state over said image source tape between said printing head and platen, said image receiving tape having a printing surface facing said image source tape, an image being transferred to said printing surface through said image source tape by said printing head in a printing operation; and an adhesive tape accommodated in said third accommodating section, driven by said tape driving means, and applied to said printing surface of said image receiving tape after the printing operation.

2. A tape printer with the tape cassette according to claim 1, wherein:

first feed roller means is provided on said frame; and second feed roller means provided on said housing in the vicinity of said tape outlet for performing a tape feed operation in co-operation with said first feed roller means.

3. The tape cassette according to claim 1, wherein said first to third accommodating sections are provided side by side substantially in the same plane in said housing, and said third accommodating section is closer to said tape outlet than said first and second accommodating sections.

4. The tape cassette according to claim 1, wherein said adhesive tape includes a double sided adhesive layer which has a first adhesive surface to be applied to said printing surface of said image receiving tape and a second adhesive surface opposite said first adhesive surface, and a separable sheet layer applied to said second adhesive surface.

5. The tape cassette according to claim 4, wherein said image transferred to said printing surface of said image receiving tape is a mirror image.

6. A tape printer with the tape cassette according to claim 1, wherein:

said housing has a recess having a predetermined size for accommodating said printing head such that said printing head can be advanced into and retreated from said tape cassette;

tape guide means formed in said housing for guiding said image source tape such that a portion of said image source tape faces said platen when the image source tape is driven;

a portion of said image source tape facing said platen extending into said recess; and said housing is provided with biasing means for biasing said portion of said image source tape facing said platen outwardly of said recess so that said tape portion does not interfere with the advancement of said printing head into said recess at the time of loading of said tape cassette.

7. The tape cassette according to claim 1, wherein:

said image source tape and image receiving tape are driven in an overlapped state over each other along a common path in a path leading to said printing area; and a separator is provided along said common path such that the separator extends between said two tapes to prevent direct contact thereof.

8. The tape cassette according to claim 1, wherein:

said housing includes:

a guide pin for guiding said image source tape and/or image receiving tape driven partly in contact with its outer periphery; and a back tension imparting member engaging said tape or tapes and urging said tape or tapes against said guide pin, said back tension imparting member having a secured end and at least two elastic portions extending therefrom toward said tape or tapes and along and parallel to the tape running direction.

9. A common tape cassette for a label tape and a lettering tape to be detachably located in a tape printer for a printing operation, comprising:

a first accommodating section for selectively accommodating an ordinary heat transfer type image source tape;

a second accommodating section for selectively accommodating an ordinary heat transfer type image receiving tape;

a printing section in which either one of said image source tape and the corresponding image receiving tape are run in an overlapped state during a printing operation;

a third accommodating section for accommodating an adhesive tape; and a tape outlet.

10. A common tape cassette according to claim 9, wherein:

the ordinary heat transfer type image source tape comprises a substantially transparent ordinary image receiving tape having a printing surface facing said image source tape; and said adhesive tape is applied to said printing surface of said image receiving surface after printing, the two tapes applied to each other being subsequently fed out together from said tape outlet.

* * * * *

UNITED STATES PATENT AND TRADEMARK OFFICE

CERTIFICATE OF CORRECTION

PATENT NO. : 4,927,278

DATED : May 22, 1990

INVENTOR(S) : Kuzuya et al (II)

It is certified that error appears in the above-identified patent and that said Letters Patent is hereby corrected as shown below:

Claim 9, column 19, line 11, "either one of" should be deleted.

Signed and Sealed this

Seventh Day of January, 1992

*Attest:*

HARRY F. MANBECK, JR.

*Attesting Officer*

*Commissioner of Patents and Trademarks*